United States Patent [19]

Juzefczyk

[11] Patent Number: 4,597,191

[45] Date of Patent: Jul. 1, 1986

[54] HAIR TREATMENT APPARATUS

[76] Inventor: Adrienne L. Juzefczyk, 315-J Acebo La., San Clemente, Calif. 92672

[21] Appl. No.: 659,177

[22] Filed: Oct. 9, 1984

[51] Int. Cl.[4] ..... A45D 19/00

[52] U.S. Cl. ..... 34/60; 34/97; 422/125; 422/306

[58] Field of Search ..... 34/3, 60, 61, 96, 97, 34/91; 132/7, 9; 422/124, 125, 30, 4, 306

[56] References Cited

U.S. PATENT DOCUMENTS 1,112,807 10/1914 King ..... 422/124
2,050,773 8/1936 Wall ..... 422/124
2,081,034 5/1937 Carter ..... 422/306
3,947,659 3/1976 Ono ..... 34/91

*Primary Examiner*—Larry I. Schwartz
*Attorney, Agent, or Firm*—Charles T. Silberberg

[57] ABSTRACT

A hair treatment means in the form of a flexible web substrate carrying a hair treating agent is connected to a support means. The treating agent is transferred to the hair with an air current passing through the substrate. The support means is preferably connected to the air outlet of a portable hair dryer. Optimally, there are a plurality of substrates, each carrying a treating agent, which are removably attached to the support means.

11 Claims, 5 Drawing Figures

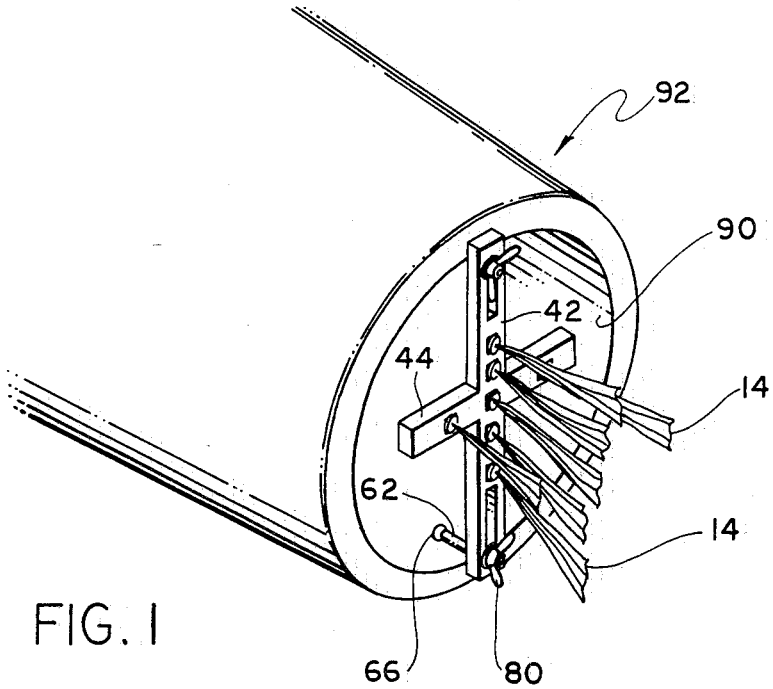
FIG. 1
FIG. 2
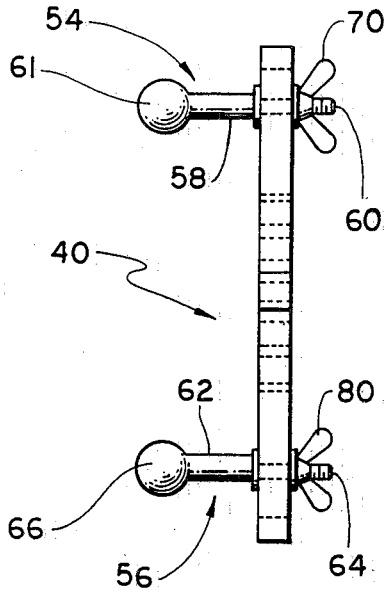
FIG. 4
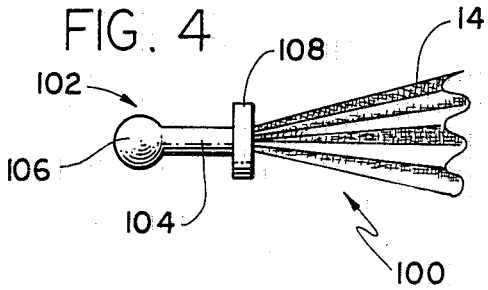
FIG. 3
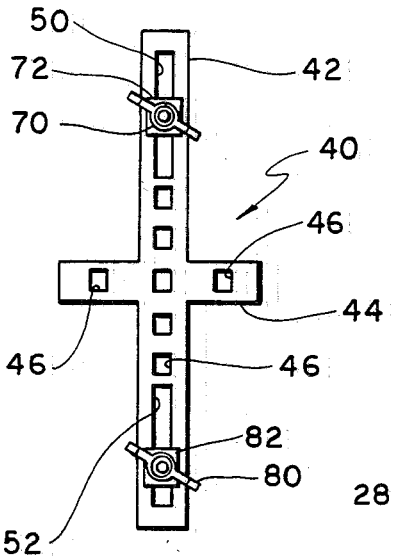
FIG. 5
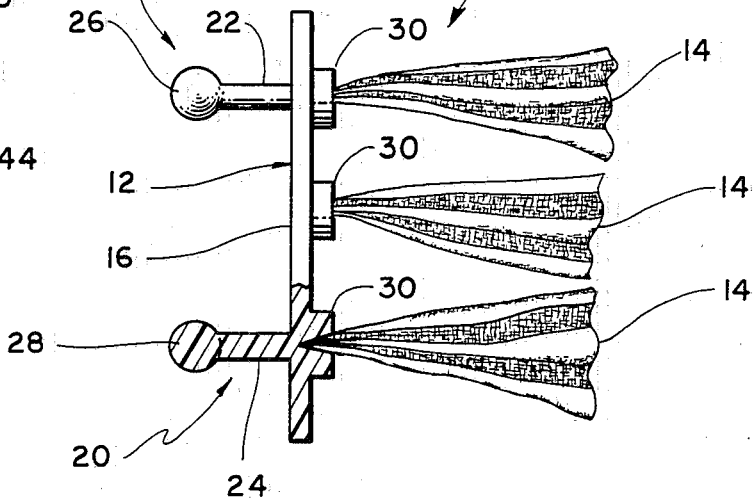

HAIR TREATMENT APPARATUS

FIELD OF THE INVENTION

This invention relates to the treatment of hair. More particulary, the invention relates to a device and method for treating hair which involves transferring of a treating agent from a flexible web substrate to the hair with a current of air passing through the substrate.

BACKGROUND OF THE INVENTION

Hair dryers, particularly the portable type, have seen widespread usage over recent years. Because of the speed of drying time, people can wash their hair more frequently. However, frequent use of a hair dryer to dry hair often results in damaging effects to the hair, such as a loss of body and manageablity, dryness, brittleness, and split ends. It has also been discovered that use of hair dryers can also impart an unpleasant odor to the hair. Present conditions which are applied to the hair prior to the drying process do produce some improvement, but have not been entirely satisfactory, and are inconvenient and expensive.

It is known to have vapors dispensed by a hair dryer. In U.S. Pat. No. 4,195,416 to Hall, there is disclosed a portable dryer which is secured in a cabinent. A vaporizing substance is positioned in the cabinent adjacent the inlet of the dryer. The substance, which is disclosed to be a room freshener, fumigant, or insectacide is drawn into the dryer and expelled from a vent in the cabinent. Such a cabinent device would of course be unsuitable for hair treatment.

U.S. Pat. No. 4,074,369 to Harmon discloses a hair treatment device involving a hair dryer. This is accomplished by providing water, shampoo, or heated air to a cap worn around a person's hair. However, use of the dryer only occurs independently, i.e., after the hair is shampooed and washed.

U.S. Pat. Nos. 3,442,692 to Gaiser and 3,994,694 to McQueary disclose the use of substates carrying fabric conditions. However, this is for conditioning fabrics in a clothes dryer, where the unsupported substrates are placed in a dryer for commingling with the clothes.

SUMMARY OF THE INVENTION

It is, therefore, an object of the present invention to provide a simple, economical, convenient, and effective device for treating hair.

It is another object of the present invention to provide a method and apparatus for treating hair where a treating agent is applied to the hair with a current of air.

It is yet another object of the present invention to provide a device that can be connected to a portable hair dryer which will apply a hair conditioner and/or perfume to the hair with the air expelled from the hair dryer.

Briefly, in accordance with the invention, there is provided, an apparatus for treating hair which comprises a support means and a hair treatment means connected thereto. The hair treatment means comprises a flexible web substrate which carries a treating agent. The treating agent is transferred to the hair with an air current which passes through the hair treatment means. Preferably, there are a plurality of substrates, with each carrying a treating agent, which are removably connected to the support means.

In one embodiment of the invention, the support means is connected to the air outlet of a portable hair dryer such that the treating agent is applied to the hair with air expelled from the hair dryer.

In the method of the present invention, there is provided a substrate carrying a treating agent. A current of air is directed through the substrate such that the treating agent is transferred to the hair.

Other objects and advantages of the invention will become apparent upon reading the following detailed description and upon reference to the drawings.

BRIEF DESCRIPTION OF THE DRAWINGS

FIG. 1 is a perspective view of a hair treatment device according to the present invention which is attached to the air outlet of a portable hair dryer (only a portion of the hair dryer is shown);

FIG. 2 is a side elevational view of the support means of the device of FIG. 1;

FIG. 3 is a front elevational view of the support means of the device of FIG. 1;

FIG. 4 is a side elevational view of one of the flexible web substrates which make up the hair treatment means of the device of FIG. 1; and FIG. 5 is a side elevational view with a portion thereof in cross section of another embodiment of the present invention.

While the invention will be described in connection with the preferred embodiments, it will be understood that it is not intended to limit the invention to those embodiments. On the contrary, it is intended to cover all alternatives, modifications, and equivalents which may be included within the spirit and scope of the invention as defined by the appended claims.

DETAILED DESCRIPTION OF THE INVENTION

Referring now to FIG. 5 there is shown a first embodiment of a hair treatment device according to the present invention which is generally indicated at 10. Device 10 includes a support means 12 and hair treatment means 14.

The support means 12 is in the form of a rectangular bar 16. The bar is preferably made from a heat resistant plastic. The bar is preferably substantially rigid for reasons to be discussed. Support means 12 also includes two fastening members generally indicated at 18 and 20. Members 18 and 20 are designed to removably connect the device 10 to an air outlet of a hair dryer. Members 18 and 20, which are integral with bar 16 in this embodiment, each have a rod 22 and 24 respectively which projects rearwardly and substantially perpendicularly from the bar 16. Rods 22 and 24 terminate in enlarged spherical portions 26 and 28 respectively. Members 18 and 20 serve as detents to snap in and out of the rim of the air outlet of a hair dryer. As such, rods 22 and 24 are slightly flexible relative to bar 16. The positioning and size of fasteners 18 and 20 and bar 16 is dependent upon the size and shape of the air outlet of the hair dryer for which device 10 is to connect to. Accordingly, device 10 would be specifically designed for a given hair dryer (which could be a standard or most common size for hair dryer).

Also integrally attached to bar 16 are a plurality of flexible web substrates 14. While as few as one of these substrates can be used according to the invention, a plurality, normally three to five, is preferred. The substrates 14 each carry a hair treating agent, which could be a hair conditioner, perfume, or combination thereof.

the substrates 14 in the form of sheets are gathered at one end where they are embedded into the bar 16 at flanges 30.

Suitable substrate materials include a variety of natural or synthetic materials. The materials should have the ability to retain a hair treating agent in a form which is releasable with an air stream passing through the material and which have a resistance to shredding or other tearing failures. Examples include paper toweling and swatches of woven and non-woven cloth. The preferred material is non-woven rayon cloth.

Incorporation of the agent into the substrate can readily be effected by coating a sheet of the substrate with a liquid solution or dispersion of the agent, as by immersion, or by spraying, wringing or pressing out the excess, and then drying the substrate to leave it uniformly impregnated with the desired amount of agent. The amount of treating agent carried by the substrate should be sufficient to provide the desired treating effect without substantial excess. The amount will vary in any given case, and will depend on the nature of the agent and the substrate material and the type of treating effect desired.

As previously noted, the support means 12 (though not neccessarily the fastening means for the support means) is preferably substantially rigid. This is to enable particular and uniform positioning of the substrates 14 relative to the outlet of the hair dryer and to avoid too much stress on the device 10 and hair dryer exit nozzle by bending of device 10 while attached to the hair dryer, which could result in a fracture (see FIG. 1).

Referring now to FIGS. 1–4, there is shown another embodiment of the invention. In this case, the support means 40 is in the form of a pair of intersecting rectangular bars 42 and 44 oriented to result in a cross shape. Bars 42 and 44 are normally integral. Each of bars 42 and 44 include a number of selectively positioned apertures 46. Bar 42 also has longitudinal slots 50 and 52 at its opposite ends. Positioned in slots 50 and 52 are fastener detents 54 and 56. Detent 54 includes a rod 58 which is threaded at one end 60 and enlarged in a spherical portion 61 at the other end. Similarly, detent 56 includes a rod 62 with threaded end 64 and enlarged spherical end 66. Rods 58 and 62 project rearwardly and substantially perpendicularly from bar 42. Detent 54 is retained in slot 50 by a wing nut 70 and washer 72 which are mounted on threaded end 60. Likewise, detent 56 is retained in slot 52 by wing nut 80 and washer 82 mounted on threaded end 64. The position of detents 54 and 56 is movable in slots 50 and 52 by loosening of wing nuts 70 and 80. Detents 54 and 56 snap into the rim of air outlet 90 of hair dryer 92 to fasten the support means 40 to the hair dryer. Rods 58 and 62 should be slightly flexible relative to bar 42 to effect this purpose. Detents 54 and 56 can be positioned in slots 50 and 52 to accomodate various sizes of hair dryer air outlets.

Support means 40 is designed to accomodate a plurality of hair treating members 100. Members 100 include a flexible web substrate 14 carrying a hair treating agent as previously described. Substrate 14 is again gathered at one end where it is joined to a resilient tab 102. Tab 102 includes a rod 104 and a spherical enlarged end 106. Tab 102 also has a cylindrical flange 108 where substrate 14 joins rod 104.

As best seen in FIGS. 1 and 3, members 102 are inserted into apertures 46 of support means 40 where they are locked into place by ends 106 and flanges 108. While a plurality of members 102 would normally be used, it is possible to use just one. With device 40, the number of members 102, their position, and nature (such as a hair conditioner or perfume) can be varied. The members 102 can be removed after an application with replacements substituted for the next use. Thus, this embodiment results in the economy of only having to replace members 102 after a use instead of the whole unit.

In using the second embodiment, the support means 40 is connected to the air outlet 90 of dryer 92. The desired number and type (conditioner, perfume, or both) of members 102 are inserted into selected apertures 46. Positioning of members 102 may be for various purposes, e.g., to assure uniform or varied application of the treating agent. Air expelled from the dryer transfers the treating agent to the hair with the air current passing through the flexible substrates 14. Preferably, the treating agent would only be transferred when the air from the dryer is heated and the treating agent vaporized as a result.

Thus, it is apparent that there has been provided, in accordance with the invention, a hair treatment method and apparatus that fully satisfies the objectives, aims, and advantages set forth above. While the invention has been described in connection with specific embodiments thereof, it is evident that many alternatives, modifications, and variations will be apparent to those skilled in the art in light of the foregoing description. Accordingly, it is intended to embrace all such alternatives, modifications, and variations which will fall within the spirit and scope of the appended claims.

I claim:

1. An apparatus for treating hair comprising:

a support means having a plurality of apertures; and hair treatment means removably connected to said support means for transferring at least one treating agent to the hair with an air current passing into contact with said hair treatment means, said hair treatment means comprising a plurality of flexible web substrates, each substrate carrying a treating agent, each of said substrates having a fastener means for removable connection to said support means, said substrates being connected to said support means at selected locations thereon by their respective fastener means being inserted into respective apertures.

2. The apparatus of claim 1, wherein said treating agent is a conditioner, perfume, or combination thereof.

3. The apparatus of claim 1, wherein said air current is heated.

4. The apparatus of claim 2, wherein said support means is substantially rigid and said flexible substrate is a non-woven cloth web.

5. Apparatus for treating hair comprising:

a portable hair dryer having an air outlet;

a support means having a plurality of apertures connected to said hair dryer adjacent said air outlet; and hair treatment means removably connected to said support means for transferring at least one treating agent to the hair with air expelled from said hair dryer, said hair treatment means comprising a plurality of flexible web substrates, each substrate carrying a treating agent, each of said substrates having a fastener means for removable connection to said support means, said substrates being connected to said support means at selected locations thereon by their respective fastener means being inserted into respective apertures.

6. The apparatus of claim 5, wherein said treating agent is a hair conditioner, perfume, or combination thereof.

7. The apparatus of claim 5, wherein said flexible substate is a non-woven cloth web.

8. The apparatus of claim 5, wherein said support means has an adjustable fastening means such that said support means can be connected adjacent to air outlets of different sizes.

9. The apparatus of claim 5, wherein said treating agent is transferred to the hair with heated air expelled from said hair dryer.

10. An apparatus for treating hair comprising:

a support means; and hair treatment means connected to said support means for transferring a treating agent to the hair with an air current passing into contact with said hair treatment means, said hair treatment means comprising a flexible web substrate carrying said treating agent, said substrate connected to said support means such that it is substantially free to sway with the air current passing into contact therewith.

11. The apparatus of claim 10, also including a portable hair dryer having an air outlet, said support means being connected to said hair dryer, said substrate being positioned substantially outside of said hair dryer.

* * * * *